United States Patent [19]

Lamond et al.

[11] Patent Number: 4,640,484

[45] Date of Patent: Feb. 3, 1987

[54] SUPPORT COLUMN WITH GRAVITY DEPENDENT RETENTION MEANS

[75] Inventors: Lee T. Lamond, North Wales, Pa.; Richard D. Staton, Collingswood, N.J.

[73] Assignee: Fichtel & Sachs Industries, Colmar, Pa.

[21] Appl. No.: 730,796

[22] Filed: May 6, 1985

[51] Int. Cl.[4] ..... F16M 11/28

[52] U.S. Cl. ..... 248/407; 248/423

[58] Field of Search ..... 248/407, 412, 161, 414, 248/423, 162.1, 157, 354.6, 354.4; 108/146, 147; 297/345, 347

[56] References Cited

U.S. PATENT DOCUMENTS

| | | | |
|---|---|---|---|
| 1,620,913 | 3/1927 | Orwig | 248/412 X |
| 2,961,260 | 11/1960 | Newlin | 248/161 X |
| 3,201,079 | 8/1965 | Doetsch | 248/412 |
| 3,285,207 | 12/1966 | Hagen . | |
| 3,741,514 | 6/1973 | Snurr | 248/412 |
| 3,788,587 | 1/1974 | Stemmler . | |
| 4,580,749 | 4/1986 | Howard | 248/161 |

FOREIGN PATENT DOCUMENTS

| | | | |
|---|---|---|---|
| 1086361 | 8/1954 | France | 108/146 |
| 1101248 | 4/1955 | France | 248/161 |
| 1247425 | 10/1960 | France | 108/146 |
| 1449684 | 7/1966 | France | 248/412 |
| 241984 | 9/1946 | Switzerland | 248/161 |

*Primary Examiner*—Ramon S. Britts

*Assistant Examiner*—Karen J. Chotkowski

*Attorney, Agent, or Firm*—Brumbaugh, Graves, Donohue & Raymond

[57] ABSTRACT

A support column unit for an adjustable-height chair and the like comprises upper and lower telescoping tubular members, a piston-and-cylinder type pneumatic spring located coaxially within the tubular members and having its cylinder member secured to the lower tubular member, and a gravity dependent locking mechanism for locking the piston rod member of the pneumatic spring to the upper tubular member when the support column is upright and for releasing the piston rod member when the support column is inverted. The locking mechanism comprises a lock body retained within the upper tubular member and having a bore sized and positioned to permit sliding axial movement of the piston rod member therein. The lock body has one or more cavities, each one in communication with the bore and containing a locking member. The cavities and the locking members are sized and shaped such that when the support column is upright, each locking member falls to a position in which a portion thereof protrudes into the bore, and when the column is inverted, each locking member falls to a position in which it is fully retracted from the bore. The piston rod member has an annular retaining groove shaped to engage the portions of the locking members that protrude into the bore to achieve locking of the piston rod member to the lock body when the column is upright.

13 Claims, 12 Drawing Figures

SUPPORT COLUMN WITH GRAVITY DEPENDENT RETENTION MEANS

BACKGROUND OF THE INVENTION

1. Field of the Invention the present invention relates to adjustable-length, telescoping support columns of the type having a pneumatic spring as the operating element, and more particularly to such support columns in which the telescoping members are locked together by gravity dependent locking means for easy assembly and disassembly of the column.

2. The Prior Art

Adjustable length support column units having pneumatic spring operating elements are know in the art and are commonly used in adjustable-height chairs, tables and the like. Generally, such units comprise two telescoping tubular members, an upper member attached to a surface being supported, such as a chair seat, and a lower member attached to the supporting structure for the surface, such as the pedestal of the chair. A piston-and-cylinder type pneumatic spring containing a gas or a gas-fluid mixture under high pressure is located coaxially within the tubular members, with the piston rod member being operatively connected in load-transmitting relationship to one of the tubular members and the cylinder member being similarly connected to the other tubular member. The overall length of the pneumatic spring, and thus the length of the support column, may be adjusted by manual operation of a valve mechanism internal to the spring.

Support column units of the above-described type are generally designed to permit the unit to be disassembled and reassembled in the field for the purpose of recharging or replacing the pneumatic spring after it has failed. Although the pneumatic spring of a support column unit in typical applications, such as in an adjustable-height chair, has a relatively long useful life, the other components of the unit have even longer useful lines. As such, it is more economical to recharge or replace the pneumatic spring when it fails rather than to discard the entire support column unit. Therefore, it is advantageous and desirable to provide a support column that is easy to disassemble and to reassemble.

In prior art field-reparable support column units, the piston rod member or the cylinder member of the pneumatic spring is normally secured near the bottom end of the lower tubular member by an appropriate fastener, such as a snap ring, while the other member of the pneumatic spring is normally inserted axially into the upper tubular member and is releasably retained therein by spring clips, plugs, ball detents, etc., acting between the upper tubular member and the gas spring member. Examples of prior art support column units having such releasable retention systems are described in U.S. Pat. No. 3,788,587, which issued on Jan. 29, 1974 to the assignee of the present application.

Although these prior art releasable retention systems do facilitate to some degree the assembly and disassembly of the support column unit, such systems have not been entirely satisfactory from the standpoint of cost and convenience. For example, it is relatively expensive to manufacture pneumatic springs having retention structures, such as ball detents or retaining grooves, in the cylinder member, since the cylinder member is normally constructed with relatively thin-walled tubing. In addition, where spring clips, plugs or the like are used to fasten the pneumatic spring to the upper tubular member, such small, detachable fasteners are subject to being lost upon removal and to being loosened during normal use of the support column unit. Moreover, such fasteners are generally difficult to remove and install, often requiring the use of tools. Therefore, a need clearly exists for a support column which is easy to assemble and disassemble without tools, which is of lower cost then prior art support columns and which does not require the removal of fasteners for disassembly.

SUMMARY OF THE INVENTION

The foregoing and other shortcomings of the prior art are overcome by the present invention, in accordance with which a support column includes a novel gravity dependent locking arrangement in its upper tubular member for positively engaging a retaining groove in the piston rod member of the pneumatic spring when the column is upright, and for releasing the piston rod member when the column is inverted. The cylinder member of the pneumatic spring is secured to the lower tubular member of the support column.

The locking arrangement includes a lock body retained within the upper tubular member and having a bore sized and positioned to permit axial movement of the piston rob member therein. The lock body has one or more cavities, each one in communication with the bore, and a locking member within each one of the cavities. The cavities and the locking members are sized and shaped such that, when the column is upright, each locking member falls to a position in which a portion thereof protrudes into the bores and when the column is inverted, each locking member falls to another position in which it is fully retracted from the bore. The piston rod member has a retaining groove which is shaped to engage the portions of the locking members that protrude into the bore of the lock body, thus causing the rod member to be locked to the upper tubular member when the column is upright. The piston rod member is released by the lock body when the support column is inverted.

The support column according to the present invention may be disassembled simply by inverting the column and withdrawing the piston rod member from the upper tubular member. The column may be assembled by holding the upper tubular member upright and inserting the piston rod member into the lock body until the retaining groove engages the locking members. Thus, disassembly and assembly of the support column is extremely easy and does not require the use of any tools or the removal or installation of any fasteners.

In a preferred embodiment, the cavities of the lock body are two cylindrically shaped passages downwardly inclined towards the bore when the support column is upright and positioned on opposing sides of the bore. Each one of the cavities terminates in an aperture at the inner surface of the bore. The locking members each comprise a cylindrically shaped lug elongated in the direction of its respective passage and sized to permit the lug to fall freely through the passage. The apertures at the inner surface of the bore are sized to prevent the lugs from falling into the bore.

Load is transmitted between the piston rod member and the lock body by means of a retaining ring engaged in a second annular groove in the rod member, the second annular groove being located below the lock body when the rod member is locked thereto.

The piston rod member also includes a spring ring detent comprising a spring ring engaged in a third annular groove in the rod member, the third annular groove being located above the lock body when the rod member is locked thereto. The spring ring detent prevents unintentional disassembly of the column when the support column is inverted, but the detent can be overcome with a sufficient pull-out force applied to the tubular members.

The lock body is retained in the upper tubular member by means of an internal annular abutment which prevents the lock body from moving in an upward axial direction and which couples the lock body and the upper tubular member in load-transmitting relationship, and a spring ring retainer clip for holding the lock body against the annular abutment.

BRIEF DESCRIPTION OF THE DRAWING

Further advantages and features of the invention will be apparent from the following detailed description of exemplary embodiments with reference to the accompanying drawings, in which.

Throughout the figures of the drawing, the same reference numerals are used to denote like features, components or portions of the illustrated apparatus.

DETAILED DESCRIPTION

Figure 1:
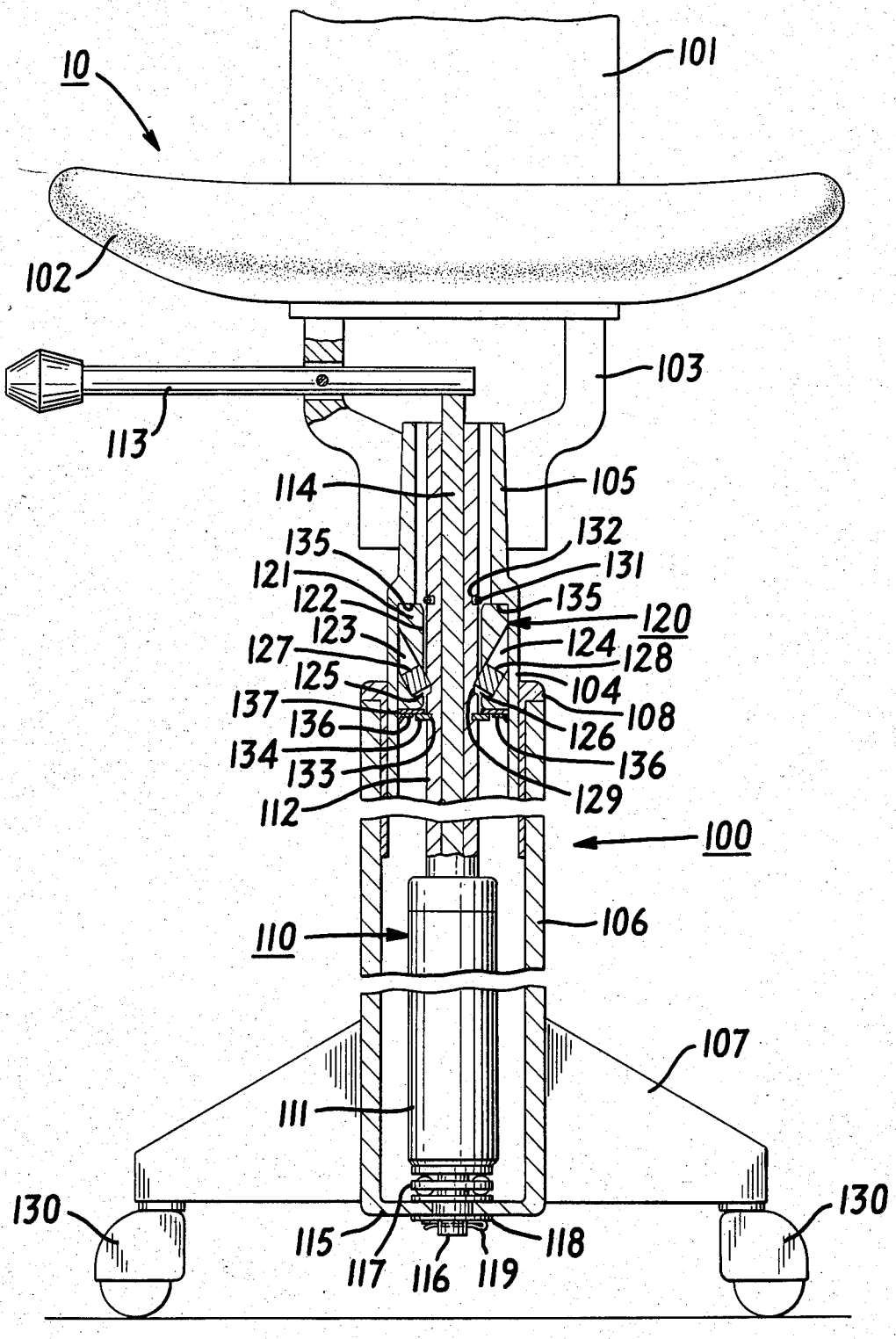
FIG. 1 is a front view of a chair having a support column according to one embodiment of the invention, shown in partial section with portions cut away.

Referring now to FIG. 1, there is shown an adjustable-height chair 10 having a support column unit 100 in accordance with one embodiment of the present invention. Although an exemplary embodiment is being described hereinbelow with reference to its use in an adjustable-height chair, it will be understood that support column units constructed in accordance with the present invention have utility in a wide variety of applications in which adjustable-length support columns are required or desirable.

The chair 10 has a seat 102 and a back rest 101, both supported by a frame 103. The support column unit 100 includes an upper tubular member 104 having a conically tapered end 105, which is inserted into a conical bore in the frame 103 and held therein in a conventional manner, such as by press fitting or clamping. The upper tubular member 104 is telescopically received in a lower tubular member 106, which is attached to the base 107 of the chair 10. A low-friction plastic bushing 108 is fitted between the upper and lower tubular members 104 and 106 to serve as a guide for the upper tubular member 104 and as a protective end cap for the upper end of the lower tubular member 106.

Situated within the upper and lower tubular members 104 and 106 is a piston-and-cylinder type pneumatic spring 110, which extends axially along the length of the support column unit 100. The pneumatic spring 110 may be essentially of conventional construction, such as those described in U.S. Pat. Nos. 3,447,645 and 4,245,826. As explained in those patents, the pneumatic spring 110 includes a cylinder member 111 containing a gas or a gas-fluid mixture at higher than atmospheric pressure, and a piston rod member 112 extending axially out of the cylinder member 111. The extension of the piston rod member 112 out of the cylinder member may be controlled by an internal valve (not shown), which is operated by manipulation of a hand lever 113 to depress a valve actuation pin 114 extending into the cylinder member 111 through the center of the piston rod member 112.

The cylinder member 111 of the pneumatic spring 110 is attached to an end plate 115 at the bottom of the lower tubular member 106 in a conventional manner. The free end of the cylinder member 111 terminates in a short rod section 116 of a smaller diameter than the cylinder member 111. The rod section 116, which passes through a thrust bearing assembly 117, an aperture in the end plate 115 and a washer 118, is held by a cotter pin fastener 119.

In accordance with the present invention, the piston rod member 112 of the pneumatic spring 110 is locked to the upper tubular member 104 by a novel gravity dependent locking mechanism 120. The locking mechanism includes a metal lock body 121, which fits within the upper tubular member 104 and is retained therein. The lock body 121 has a bore 122, which is sized and positioned to allow sliding axial movement of the piston rod member 112 therethrough. In addition, the lock body 121 has two cavities 123 and 124, positioned on opposite sides of the bore 122 and shaped as cylindrical passages which are downwardly inclined towards the bore 122 when the support column unit 100 is upright, i.e., the unit 100 has a generally vertical orientation with the upper tubular member 104 above the lower tubular member 106. The cavities 123 and 124 are each in communication with the bore 122 through a respective aperture 125 and 126 in the inner surface of the bore 122.

Each of the cavities 123 and 124 encloses a locking member 127 and 128 in the shape of a cylindrical lug, elongated in the direction of its respective passage and sized to permit the lug to fall freely through the passage. When the support column unit 100 is upright, each of the locking members 127 and 128 falls to a position, as shown in FIG. 1, in which a portion thereof protrudes into the bore 122 through a respective one of the apertures 125 and 126. The piston rod member 112 has an annular retaining groove 129, which is shaped to engage the portions of the locking members 127 and 128 that protrude into the bore 122, such that the piston rod member 112 is retained or locked to the upper tubular member 104 when the support column unit is upright. However, when the support column unit 100 is inverted, i.e., the unit 100 has a generally vertical orientation with the lower tubular member 106 above the upper tubular member 104, each of the locking members 127 and 128 falls to a position in which it is fully retracted from the bore 122, and there is no engagement of the locking members with the retaining groove 129. With the locking members 127 and 128 retracted, the piston rod member 112 may be withdrawn from the upper tubular member 104.

The apertures 125 and 126 are advantageously sized and shaped to prevent the lugs 127 and 128 from falling into the bore when the piston rod member is removed therefrom.

It is beneficial to provide the piston rod member with a detent lock to prevent unintentional withdrawal of the piston rod member 112 when the support column unit 100 is inverted for reasons other than disassembly. For example, the support column of a chair may be inverted when the chair is being moved or when repairs are being made to the chair casters 130. Such a detent lock may be in the form of a split spring ring 131 loosely held in an annular groove 132 in the piston rod member 112, the annular groove 132 being located above the lock body 121 when the rod member 112 is locked thereto. The spring ring 131 engages the lock body 121 when withdrawal of the piston rod member 112 is attempted while the support column unit 100 is inverted. However, the detent lock may be overcome by applying sufficient pull-out force between the upper and lower tubular members 104 and 106.

It is advantageous to provide the piston rod member 112 with separate means for coupling to the lock body 121 in load-transmitting relationship. Such load-transmitting coupling means may be in the form of a snap-on retaining ring 134 held in an annular groove 133 in the rod member 112, the annular groove 133 being located below the lock body 121 when the rod member 112 is locked thereto. A washer 137 having an aperture sized and positioned to pass the piston rod member 112 is advantageously interposed between the retaining ring 134 and the lock body 121.

The lock body 121 is retained in the upper tubular member 104 by means of an internal annular abutment 135 within the upper tubular member 104 for preventing the lock body 121 from moving in the upward axial direction, and a spring ring retainer clip 136 acting against the inner surface of the upper tubular member 104 for preventing the lock body from moving in the downward axial direction and for holding the lock body 121 against the annular abutment 135. The annular abutment 135 also serves to couple the lock body 121 to the upper tubular member 104 in load-transmitting relationship.

Figure 2:
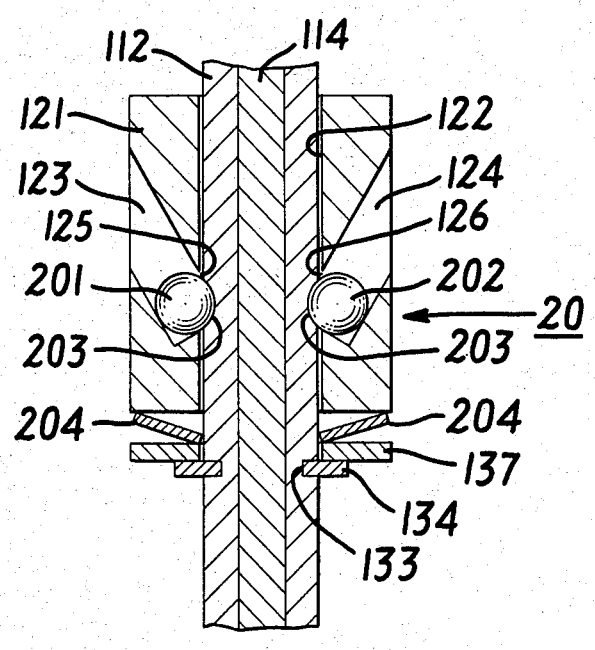
FIG. 2 is a partially sectional side view of the locking mechanism of a support column according to an alternative embodiment of the invention.

Turning now to FIG. 2, there is shown the locking mechanism 20 of a support column unit according to an alternative embodiment of the present invention. The lock body 121 and the cavities 123 and 124 therein are similar to those of the support column of FIG. 1. However, the locking members 201 and 202 within the cavities 123 and 124 are in the form of steel balls sized to fall freely through their respective cavities 123 and 124. The apertures 125 and 126 in the inner wall of the bore 122 are shaped and sized to permit portions of the balls 201 and 202 to protrude into the bore 122 when the support column unit is upright and to prevent the balls 201 and 202 from falling into the bore 122 when the piston rod member 112 is removed therefrom. The annular retaining groove 203 of the piston rod member 112 has an appropriate semicircular cross-section for engaging the portions of balls 201 and 202 which protrude into the bore 122 to achieve locking of the rod member 112 to the lock body 121. As in the support column of FIG. 1, a snap-on retaining ring 134 engaged in an annular groove 133 and a washer 137 provide load-transmitting coupling between the rod member 112 and the lock body 121. A compression spring 204 is interposed between the washer 137 and the lock body 121 for providing preloading of the engagement between the retaining groove 203 and the balls 201 and 202. Such preloading prevents inadvertent disengagement when the column is jostled during use. The compression spring 204 is advantageously in the form of a Belleville curved or wave spring.

Figure 3B:
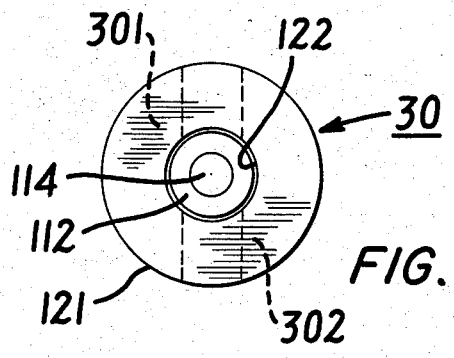
FIG. 3B is a top view of the locking mechanism of FIG. 3A.
Figure 3A:
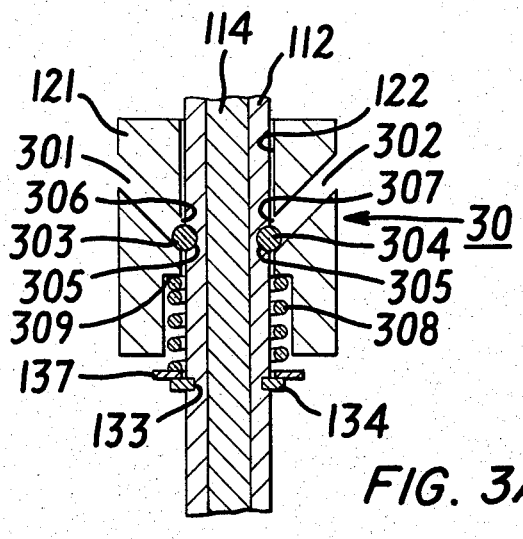
FIG. 3A is a sectional side view of the locking mechanism of a support column according to another alternate embodiment of the invention.
Figure 3C:
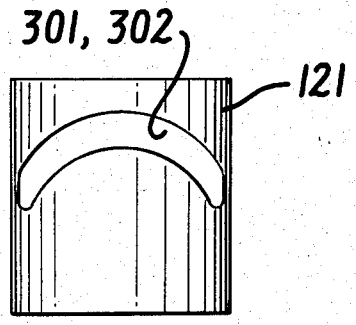
FIG. 3C is a side view of the lock body of the locking mechanism of FIG. 3A, showing one of the slot-shaped passages.

Referring now to FIGS. 3A and 3B, there is depicted the locking mechanism 30 of a support column unit according to another alternative embodiment of the present invention. The lock body 121 is similar to that of the support column unit of FIG. 1; however, the cavities 301 and 302 are slot-shaped passages, which are downwardly inclined towards the bore 122 when the unit is upright and terminate in apertures 306 and 307, respectively, at the inner surface of the bore 122. The slot-shaped passages are advantageously milled into the outer wall of the lock body 121 as illustrated in FIG. 3C.

Enclosed within each one of the slot-shaped passages 301 and 302 is a lock member 303 and 304 in the form of a horizontally disposed steel rod whose axis is perpendicular to the axis of the piston rod member 112. The steel rods 303 and 304 are each sized to fall freely through its respective slot-shaped passage 301 and 302. The apertures 306 and 307 are advantageously sized and shaped to permit portions of the rods 303 and 304 to protude into the bore 122 when the support column unit is upright and to prevent the rods 303 and 304 from falling into the bore when the piston rod member is removed therefrom. The annular retaining groove 305 of the piston rod member 112 has an appropriate semicircular cross-section for engaging the portions of the rods 303 and 304 that protude into the bore to achieve locking of the rod member 112 to lock body 121. As in the support column unit of FIG. 1, load-transmitting coupling between the piston rod member 112 and the lock body 121 is provided by a snap-on retaining ring 134 engaged in an annular groove 133 and a washer 137. A compression spring 308 is interposed between the washer 137 and the lock body 121 for providing preloading of the engagement between the retaining groove 305 and the rods 303 and 304. Such preloading prevents inadvertent disengagement when the column is jostled during use. The compression spring 308 is advantageously in the form of a coil spring coaxially wound around the piston rod member 112. A lower portion of the bore 122 is enlarged to provide a seat 309 for the coil spring 308.

Figure 4:
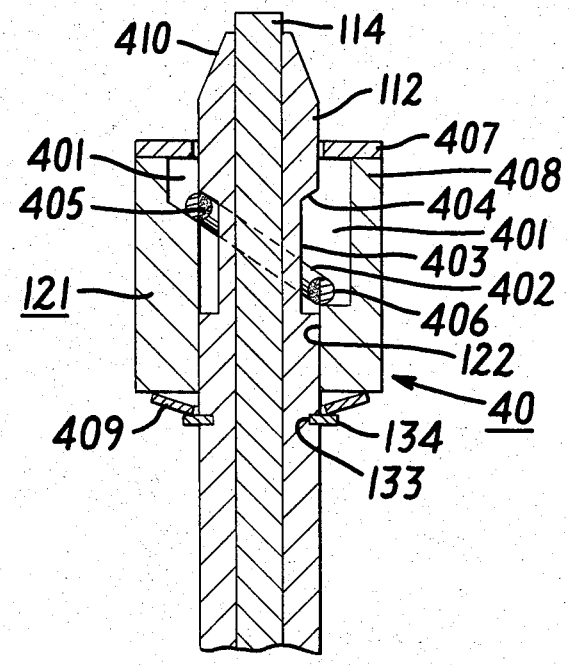
FIG. 4 is a sectional side view of the locking mechanism of a support column according to still another alternative embodiment of the invention.

Turning now to FIG. 4, there is shown the locking mechanism 40 of a support column unit according to still another alternative embodiment of the present invention. The lock body 121 includes a single cavity 401 in communication with the bore 122. The cavity 401 encloses a locking member in the form of a steel ring 402 having an opening dimensioned to pass the piston rod member 112 when the axis of the ring coincides with that of the rod member 112.

The cavity 401, the annular retaining groove 403 of the piston rod member 112 and the ring 402 are shaped and sized such that when the support column unit is upright, the ring 402 falls to a slanted position, as shown in FIG. 4, in which portions 405 and 406 thereof protrude into the bore 122, and an upper shoulder 404 of the retaining groove 403 engages a protruding portion 405 of the ring 402 to achieve locking of the rod member 112 to the lock body 121. However, when the support column unit is inverted, the ring falls to a horizontal position in which it is coaxial with the piston rod member 112, thus allowing the rod member 112 to be withdrawn from the lock body 121.

Load-transmitting coupling between the piston rod member 112 and the lock body 121 is again provided by a snap-on retaining ring 134 engaged in an annular groove 133 in the rod member 112. A compression spring 409, advantageously in the form of a Belleville curved or wave spring, is interposed between the retaining ring 134 and the lock body 121 for preloading the engagement between the retention groove 403 and the ring 402. The free end of the piston rod member 112 has a tapered section 410 for centering the ring 402 when the rod member is inserted into the bore 122. The lock body 121 is advantageously fabricated in two pieces 407 and 408 to facilitate the formation of the cavity 401 and the enclosure of the ring 402 therein.

Figure 5B:
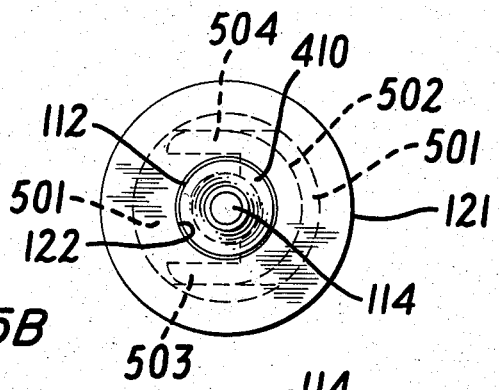
FIG. 5B is a top view of the locking mechanism of FIG. 5A.
Figure 5A:
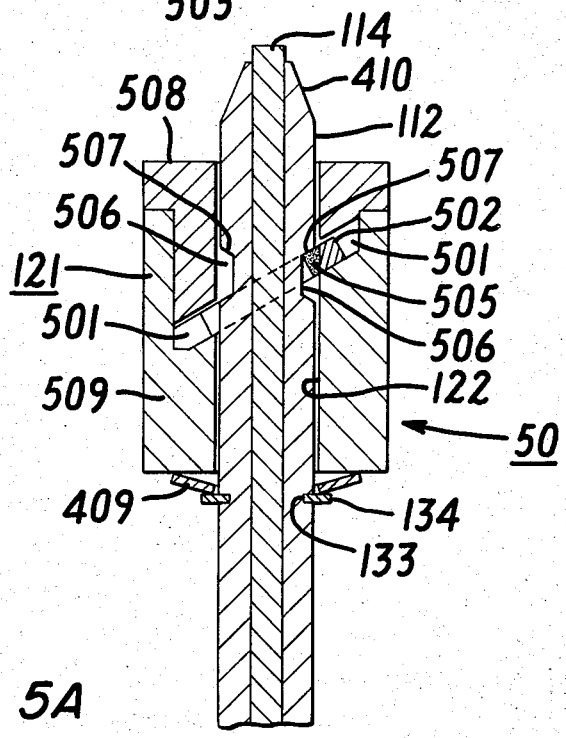
FIG. 5A is a sectional side view of the locking mechanism of a support column according to yet another alternative embodiment of the invention.

Referring now to FIGS. 5A and 5B, there is illustrated the locking mechanism 50 of a support column unit according to yet another alternative embodiment of the present invention. The lock body 121 includes a single cavity 501 in communication with the bore 122. The cavity 501 encloses a horseshoe-shaped locking member 502 having two arms 503 and 504 which straddle the bore 122. The cavity 501 and the locking member 502 being shaped and sized to permit the locking member 502 to slide freely along an inclined path while straddling the bore, such that when the support column unit is upright, an intrados portion 505 of the locking member 502 protrudes into the bore 122. The annular retaining groove 506 of the piston rod member 112 is shaped such that the upper shoulder 507 thereof engages the protruding intrados portion 505 to achieve locking of the piston rod member 112 to the lock body 121. However, when the support column unit is inverted, the locking member 502 is fully retracted from the bore 122, and the piston rod member 112 may be withdrawn from the lock body 121.

A snap-on retaining ring 134 engaged in the annular groove 133 in the piston rod member 112 provides load-transmitting coupling between the rod member 112 and the lock body 121. A compression spring 409, advantageously in the form of a Belleville curved or wave spring, is interposed between the retaining ring 133 and the lock body 121 for preloading the engagement between the retaining groove 506 and the locking member 502.

The free end of the piston rod member 112 has a tapered section 410 for pushing the locking member 502 to a retracted position when the rod member 112 is inserted into the bore 122 while the support column unit is upright.

The lock body is advantageously fabricated in two pieces 508 and 509 to facilitate the formation of the cavity 501 and the enclosure of the locking member 502 therein.

Figure 6B:
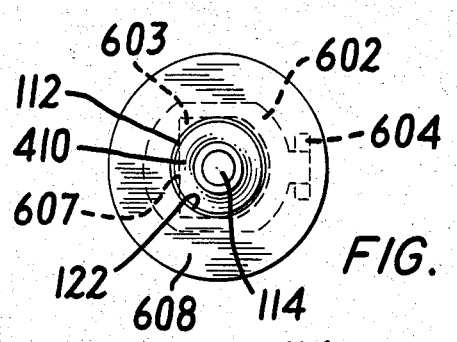
FIG. 6B is a top view of the locking mechanism of FIG. 6A.
Figure 6A:
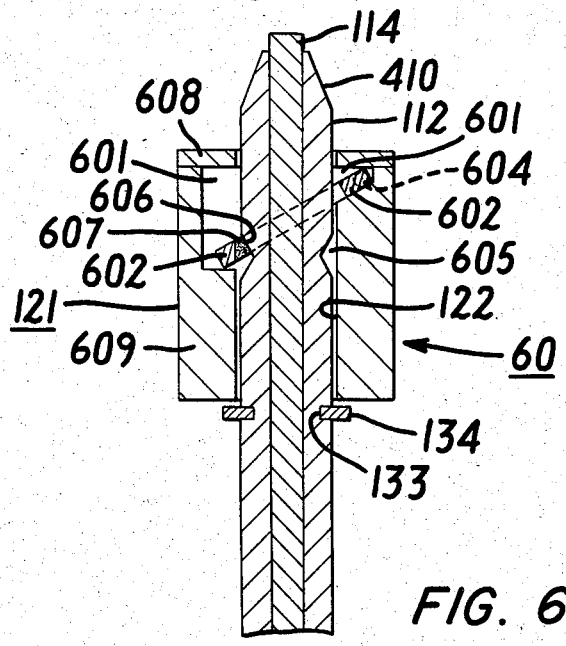
FIG. 6A is a sectional side view of the locking mechanism of a support column according to a further alternative embodiment of the invention.

Turning now to FIGS. 6A and 6B, there is depicted the locking mechanism 60 of a support column unit according to a further alternative embodiment of the present invention. The lock body 121 includes a single cavity 601 in communication with the bore 122. The cavity 601 encloses a locking member 602 in the form of a latch plate pivotally secured by a hinge pin 604 on one side thereof to freely rotate in an arc. The latch plate 602 has an aperture 603 dimensioned to pass the piston rod member 112 when the latch plate 602 is horizontally disposed. The cavity 601 and the latch plate 602 are sized and shaped such that when the support column unit is upright, the latch plate 602 is obliquely disposed, as shown in FIG. 6A, and a lip portion 607 of the latch plate 602 protrudes into the bore 122. The annular retaining groove 605 of the piston rod member 112 is shaped to engage the lip portion 607 of the latch plate 602 to achieve locking of the rod member 112 to the latch body 121. However, when the support column is inverted, the latch plate 602 swings to a horizontal position to permit the piston rod member 112 to be withdrawn from the bore 122 of the lock body 121.

Load transmitting coupling between the piston rod member 112 and the lock body 121 is again provided by a snap-on retaining ring 134 engaged in an annular groove 133 in the rod member 112.

The free end of the piston rod member 112 has a tapered section 410 to ease the insertion of the rod member into the lock body when the support column unit is upright.

The lock body 121 is advantageously fabricated in two pieces 608 and 609 to facilitate the formation of the cavity 601 and the attachment of the pivoting latch plate 602 therein.

Figure 7A:
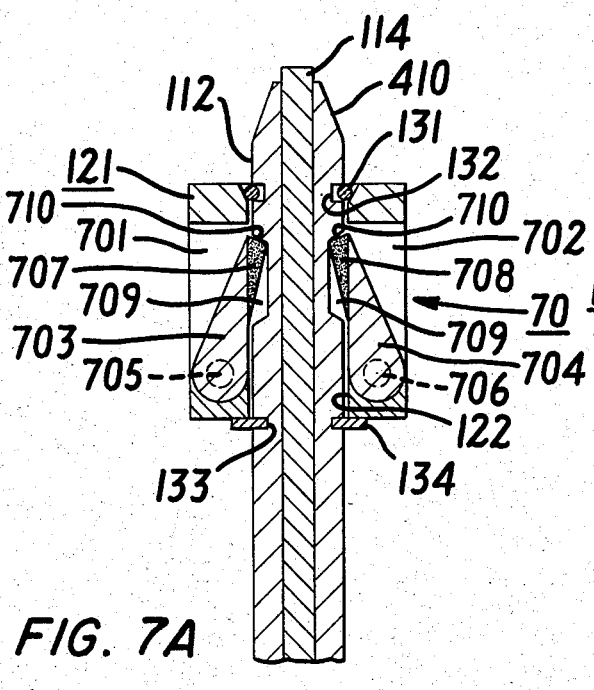
FIG. 7A is a sectional side view of the locking mechanism of a support column according to a still further alternative embodiment of the invention.
Figure 7B:
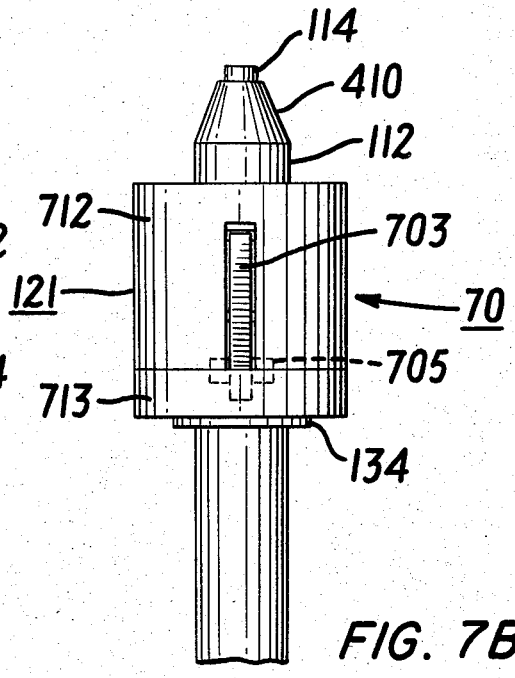
FIG. 7B is a side view of the locking mechanism of FIG. 7A, showing one of the locking members in its cavity.

Referring now to FIGS. 7A and 7B, there is shown the locking mechanism 70 of a support column unit according to still a further alternative embodiment of the present invention. The lock body 121 has two cavities 701 and 702 positioned on opposite sides of the bore 122. Each of the cavities 701 and 702 contains a locking member 703 and 704 in the form of a latch body pivotally secured by a hinge pin 705 and 706 at a lower end thereof to freely rotate towards and away from the bore 122. The cavities 701 and 702 and the latch bodies 703 and 704 are sized and shaped such that when the support column unit is upright, the latch bodies 703 and 704 are each inclined towards the bore 122 and a portion 707 and 708 of each latch body 703 and 704 protrudes into the bore 122. The annular retaining groove 709 of the piston rod member 112 is shaped such that an upper shoulder 710 thereof engages the protruding portions 707 and 708 of the latch bodies 703 and 704. However, when the support column is inverted, the latch bodies 703 and 704 swing to positions in which they are fully retracted from the bore 122 to allow the withdrawal of the piston rod member 112 from the bore 122 of the lock body 121.

A snap-on retaining ring 134 engaged in an annular groove 133 in the piston rod member 112 provides load-transmitting coupling between the rod member 112 and the lock body 121. A detent lock is provided by a spring ring 131 engaged in another annular groove 132 in the piston rod member 112.

The free end of the piston rod member 112 has a tapered section 410 for pushing the latch bodies 703 and 704 to retracted positions when the rod member 112 is inserted into the bore 122 while the support column unit is upright.

The lock body 121 is advantageously fabricated in two pieces 712 and 713 to facilitate the formation of the cavities 701 and 702 and the attachment of the latch bodies 703 and 704 therein.

Although the present invention has been described herein with reference to specific embodiments thereof, it will be understood that various modifications and alterations may be made to the disclosed embodiments by one skilled in the art without departing from the spirit or the scope of the invention as defined by the appended claims. For example, in the embodiments of FIGS. 1, 2, 3A and 7A, the lock body may have as few as one or more than two cavities enclosing locking members similar to the corresponding cavities and locking members that are illustrated in those figures.

I claim:

1. An adjustable-length support column comprising:

(a) a first tubular member for connecting to a surface to be supported;

(b) a second tubular member for connecting to a base for the surface, one of the tubular members being telescopically received within the other;

(c) pneumatic spring means located within the first and second tubular members comprising:

(1) a cylinder member, (2) a piston rod member axially movable within the cylinder member and having a first annular groove in an outwardly extending portion thereof, and (3) means for permitting adjustment of the axial position of the piston rod member relative to the cylinder member and thereby of the length of the support column;

(d) means for operatively coupling the piston rod member to the first tubular member in load-transmitting relationship thereto;

(e) means for operatively coupling the cylinder member to the second tubular member in load-transmitting relationship thereto; and (f) means for releasably locking the piston rod member within the first tubular member comprising:

(1) a lock body retained within the first tubular member and having a bore with the piston rod member slidably disposed therein, the lock body having one or more cavities inclined downwardly and communicating with the bore, (2) a locking member slideably disposed within each cavity, such that, when the column is upright and the inner ends of the cavities are adjacent the first annular groove, each locking member falls to a first position in which a portion of the locking member protrudes into the bore and, when the column is inverted, each locking member falls to a second position in which the locking member is retracted from the bore, and (3) the first annular groove in the piston rod member cooperating with the portion of each locking member that protrudes into the bore of the lock body to achieve locking of the piston rod member to the lock body when the column is upright.

2. A support column according to claim 1 wherein the lock body comprises a cylindrically shaped passage, downwardly inclined towards the bore when the column is upright and terminating in an aperture at the inner surface of the bore, and each locking member comprises a cylindrically shaped lug elongated in the direction of its respective passage and sized to permit the lug to fall through the passage and protrude through the aperture.

3. A support column according to claim 1 wherein the means for operatively coupling the piston rod member to the first tubular member comprises a second annular groove in the piston rod member located below the lock body when the piston rod member is locked thereto and a retaining ring engaged in the second annular groove for transmitting loads from the lock body to the rod member, and internal abutment means on the first tubular member for engagement with an upwardly facing surface on the lock body for transmitting load from the first tubular member to the lock body.

4. A support column according to claim 3 wherein the means for operatively coupling the piston rod member to the first tubular member further comprises a spring interposed between the retaining ring and the lock body for preloading the engagement of each locking member with the first annular groove.

5. A support column according to claim 4 wherein the spring comprises a coil spring coaxial with the piston rod member, and a lower portion of the bore is enlarged for serving as a seat for the coil spring.

6. A support column according to claim 3 further comprising a spring ring retainer clip for preventing the lock body from moving in a downward axial direction.

7. A support column according to claim 6 wherein the means for operatively coupling the piston rod member to the first tubular member further comprises a washer interposed between the retaining ring and the lock body, the washer being held against the lock body by the spring ring retainer clip and having an aperture which is sized and positioned to pass the rod member.

8. A support column according to claim 1 further comprising detent locking means for releasably engaging the lock body when the piston rod member is withdrawn from the bore while the column is inverted.

9. A support column according to claim 8 wherein the detent locking means comprise a third annular groove in the piston rod member located above the lock body when the rod member is locked thereto and a spring ring engaged in the third annular groove.

10. A support column according to claim 1 wherein each cavity terminates in an aperture at the inner surface of the bore, each aperture being dimensioned to prevent the locking member from falling completely into the bore after the piston rod is removed therefrom.

11. A support column according to claim 10 wherein the lock body has two or more cavities, each with an associated locking member positioned at circumferentially-spaced locations around the bore.

12. A support column according to claim 1 wherein each cavity of the lock body comprises a cylindrically shaped passage downwardly inclined towards the bore when the column is upright and terminating in an aperture at the inner surface of the bore, each locking member comprises a spherical locking element dimensioned to fall through its respective passage and to protrude through the respective aperture.

13. A support column according to claim 1 wherein each cavity of the lock body comprises a slot-shaped passage downwardly inclined towards the bore when the column is upright and terminating in an aperture at the inner surface of the bore, each locking member comprises a rod shaped member sized to fall through its respective passage and protrude through the respective aperture.

* * * * *